United States Patent [19]

Luke

[11] 4,168,797

[45] Sep. 25, 1979

[54] HEATED AIR DISTRIBUTION SYSTEM

[76] Inventor: Paul R. Luke, 29 Kurt Rd., Pittsford, N.Y. 14534

[21] Appl. No.: 892,268

[22] Filed: Mar. 31, 1978

[51] Int. Cl.[2] ..... F24D 5/04

[52] U.S. Cl. ..... 236/11; 98/33 A; 237/48

[58] Field of Search ..... 236/11; 98/33 R, 33 A; 237/48, 46

[56] References Cited

U.S. PATENT DOCUMENTS

| | | | |
|---|---|---|---|
| 1,845,942 | 2/1932 | Stillman | 237/46 |
| 2,701,103 | 2/1955 | Coleman | 98/33 R X |
| 3,173,353 | 3/1965 | Watkins | 98/33 A X |
| 3,804,156 | 4/1974 | McDonough | 165/27 |

*Primary Examiner*—William E. Wayner
*Attorney, Agent, or Firm*—Cumpston & Shaw

[57] ABSTRACT

A heated air distribution system for a forced air heating system of a home or the like for distributing heated air preferably from a higher heated area to a lower heated area. The heated air distribution system utilizes the air return ducts of the forced air heating system which are common to the higher and lower heated areas. The heated air distribution system comprises an air forcing device coupled to the air return ducts for forcing heated air from the higher heated area through the air return ducts to the lower heated areas. This equalizes the temperatures of the air in the two areas, prevents overheating of the higher heated area and conserves energy.

6 Claims, 5 Drawing Figures

HEATED AIR DISTRIBUTION SYSTEM

BACKGROUND OF THE INVENTION

1. Field of the Invention

The invention relates generally to heating systems, and more particularly to a heated air distribution system for distributing higher heated air from one area to a lower heated area.

2. Description of the Prior Art

It is known in the prior art of which U.S. Pat. No. 3,804,156 is exemplary to disclose a heating system in which a primary source of air in one room is utilized to service the one room as well as an adjacent room. This is achieved by providing a pair of fans in the partition between the rooms designed to substantially simultaneously draw the higher heated air near the ceiling of the one room into the adjacent room, and the lower heated air near the floor of the adjacent room into the one room. This heating system does not utilize a common air return duct and hence is only usable for a pair of adjacent rooms. Accordingly, one disadvantage of this heating system is that a pair of fans located in "through-the-wall" openings is needed for each pair of rooms. This is costly and decreases the wall space available for other purposes. Another disadvantage of this heating system is that it does not utilize any pre-existing portions of normal forced air heating systems in the building such as air return ducts, grilles, registers, or the like. Consequently, a greater number of parts are needed in this system making it more costly to manufacture and install.

U.S. Pat. Nos. 3,347,025, 3,827,342 and 3,973,479 disclose air circulating systems for reducing stratification of air by preventing overheating near the ceiling and underheating near the floor. The air circulating systems achieve this by drawing warmer air adjacent the ceiling and discharging it near the floor, or reversely drawing cooler air adjacent the floor and discharging it near the ceiling. The primary disadvantage of these systems is that one system is needed for each room. In addition, such systems cannot solve the problem of distributing heat from a higher heated area in one room to a lower heated area in a room removed therefrom.

U.S. Pat. Nos. 3,817,159 and 3,884,133 disclose heating or air conditioning systems in which combined supply/return air ducts are used. The system of U.S. Pat. No. 3,884,133 suffers from the disadvantage of being complex and elaborate, comprising a series of dampers and automatic means for controlling the dampers to direct the return air flow as desired to different discharge points. This system is particularly adapted for handling fires in multi-story buildings so that the smoke from the fire area can be exhausted directly without being recirculated through the building.

SUMMARY OF THE INVENTION

In accordance with a preferred embodiment of the invention, a heated air distribution system is disclosed for distributing higher heated air from a first area such as a room to lower heated air in a second area or room. The heated air distribution system is preferably used in combination with a forced air heating system having an air supply means, and a furnace for heating the air and supplying the heated air through the air supply means to at least the first area. The forced air heating system further has an air return means common to the first and second areas for returning lower heated air from the first and second areas to the furnace. The heated air distribution system further has means coupled to the air return means for forcing heated air from the first area through the air return means into the second area.

In a further aspect of the invention, the heated air forcing means comprises a fan, and means for rotatably driving the fan.

In a more specific aspect of the invention, the air return means comprises a duct, and the heated air forcing means comprises a fan mounted within or attached to the duct, preferably adjacent one end. Manual or automatic control means may be provided for controlling operation of the fan. Also, auxiliary heating means such as a fireplace or space heater may be provided for heating the air in the first area to a higher temperature.

The advantages, among others, of the heated air distribution system of this invention are (1) to distribute heated air, preferably from a higher heated area to a lower heated area, (2) to equalize air temperatures in two different areas, (3) to prevent overheating of one area, (4) to conserve energy by reducing the load on the forced air heating system, and (5) to utilize existing portions of an air heating system, thereby facilitating installation and reducing installation and system costs.

The invention and its advantages will become more apparent from the detailed description of the preferred embodiments presented below.

BRIEF DESCRIPTION OF THE DRAWING

In the detailed description of the preferred embodiments of the invention presented below, reference is made to the accompanying drawings, in which.

DESCRIPTION OF THE PREFERRED EMBODIMENTS

Figure 1:
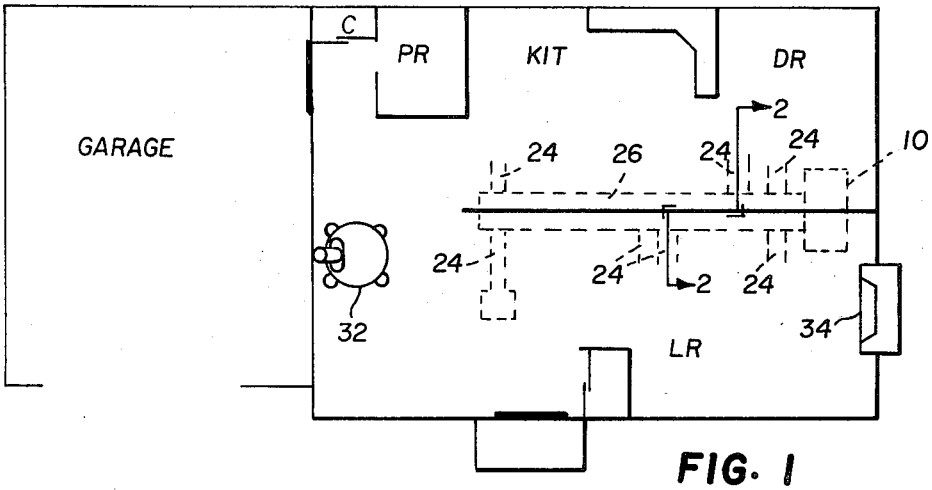
FIG. 1 is a schematic floor plan view of a building in which a preferred embodiment of the heated air distribution system of this invention is embodied.
Figure 2:
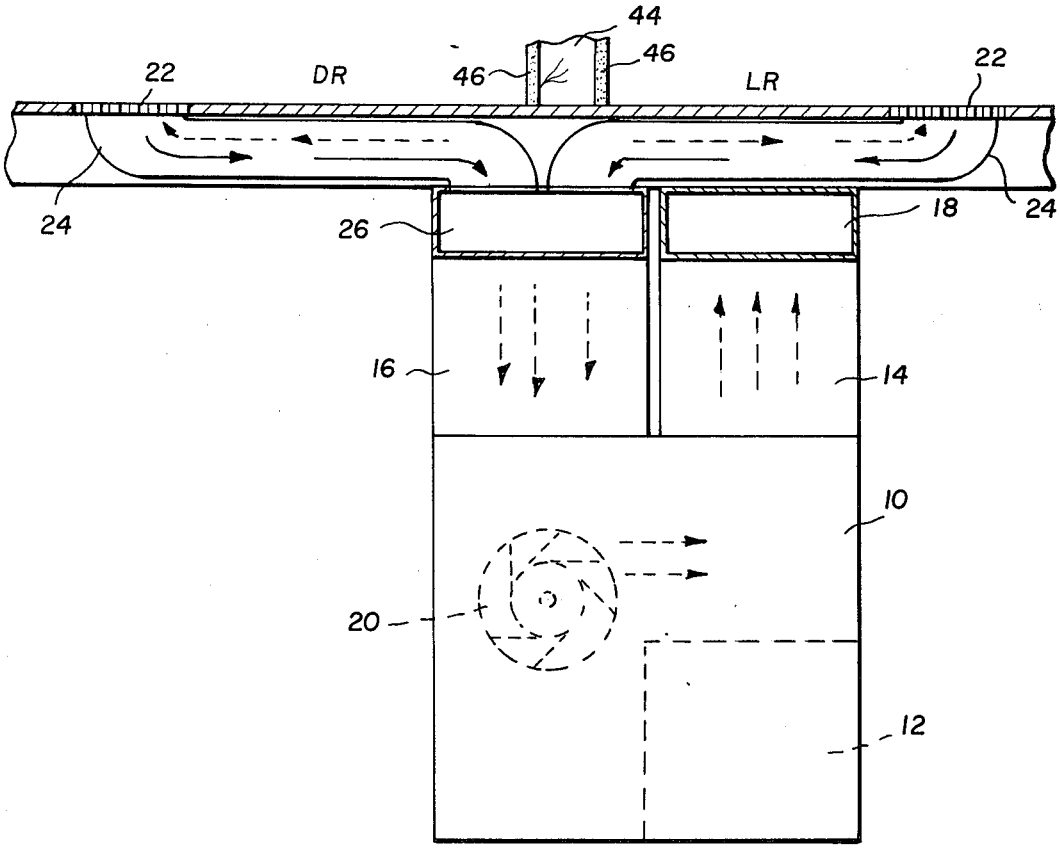
FIG. 2 is a section view taken substantially along line 2—2 of FIG. 1.

With reference to FIGS. 1 and 2, a floor plan view of a building is disclosed in which the heated air distribution system of this invention is embodied. The building is built with a conventional forced air heating system comprising a furnace 10 such as an oil or gas fired furnace having a fire box 12 for heating air in a hot air plenum 14 mounted on top thereof. Adjacent the hot air plenum 14 is mounted a cold air plenum 16. A heated air supply means comprising a sheet metal hot air trunk 18 and/or ducts is provided shown in part in FIG. 2 for connecting hot air plenum 14 to hot air registers or grilles, not shown, in each of the areas or rooms such as bedrooms (B.R.), living room (L.R.), kitchen (kit) etc. to be heated. The furnace 10 has a blower fan 20 connecting the hot and cold air plenums 14, 16 respectively. The fan 20 is preferably thermostatically controlled for forcing heated air from the hot air plenum 14 when the air reaches a predetermined temperature through the hot air supply ducts 18 and registers into the rooms.

As is well known, the hot air registers are preferably located on the walls adjacent the ceiling, but can be located on the walls adjacent the floor. The blower fan 20 also pulls cooler or cold air from the rooms through cold air registers 22 and cold air return ducts 24 and/or trunks 26 common to all of the rooms into the cold air plenum 16. The cold air registers 22 are preferably located adjacent the floor 28, but can be located adjacent the ceiling 30 as well.

If any of the rooms of a home containing the conventional forced air heating system has an auxiliary heating means such as a space heater 32 or a fireplace 34 as shown in FIG. 1, it is likely that the air in that room will become overheated. Such room may become overheated for other reasons besides an auxiliary heating means, such as location of doors, registers, etc. In any event, if any room should become overheated for any reason, it is desirable to distribute some of the higher heated air to areas in the home containing lower heated air. This is preferably accomplished in this invention by a heated air forcing means such as a fan or impellor 36 mounted in any convenient location within the air return system 24, 26, connected to the higher heated room. The fan is rotatably driven by any suitable motor 38 or the like. The fan 36 draws some of the higher heated air from the overheated room and forces the higher heated air through the air return system and into one or more of the cooler heated rooms through the cold air return ducts 24 and registers 22 located in the cooler rooms. Any excess higher heated air remaining in the air return system 24, 26 is forced by fan 36 through the cold air plenum 16 and into the hot air plenum 14 above fire box 10. This conserves energy since less heat is required from fire box 10 to heat the air in the hot air plenum 14 to the desired temperature.

Figure 4:
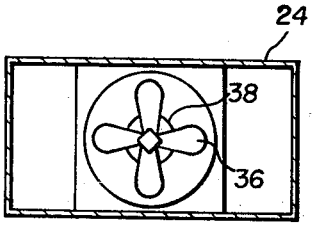
FIG. 4 is a section view taken substantially along line 4—4 of FIG. 3.
Figure 3:
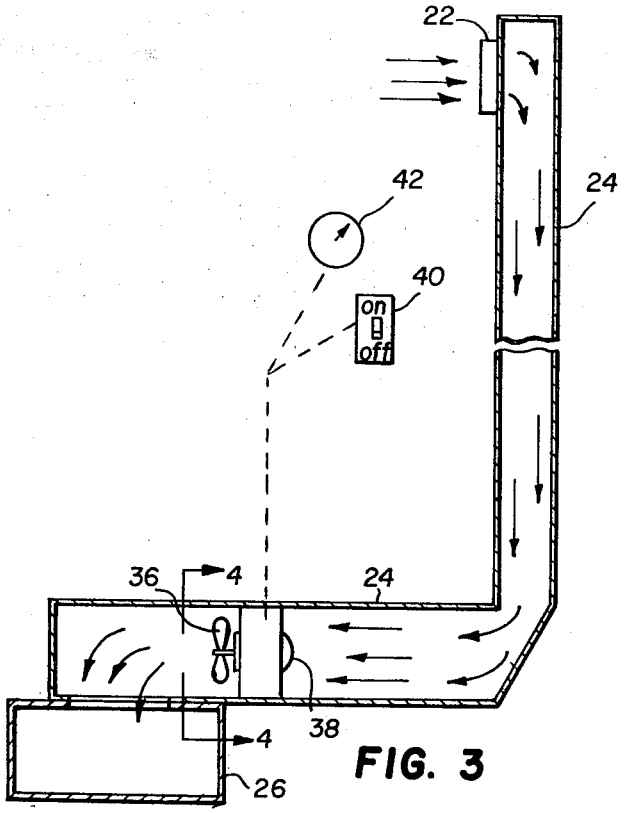
FIG. 3 is a segmental section view of a room showing the air forcing means mounted in a return air duct.

With reference to FIGS. 3 and 4, a heated air distribution system is shown that is suitable for new home or building construction. In this installation fan 36 is mounted by any suitable means within a duct 24 of the air return system. The duct 24 of the air return system is preferably formed by covering a pair of wall and floor joists with sheet metal or by providing separate rectangular or circular conduits mounted between the joists. A wall opening in the floor or ceiling, but preferably in the ceiling where the higher heated air normally accumulates, is covered by an air return grille or register 22. As illustrated by dotted lines, the motor driven fan 36 can be operated manually by an on-off wall switch 40 or thermostatically controlled by any suitable thermostat 42.

Figure 5:
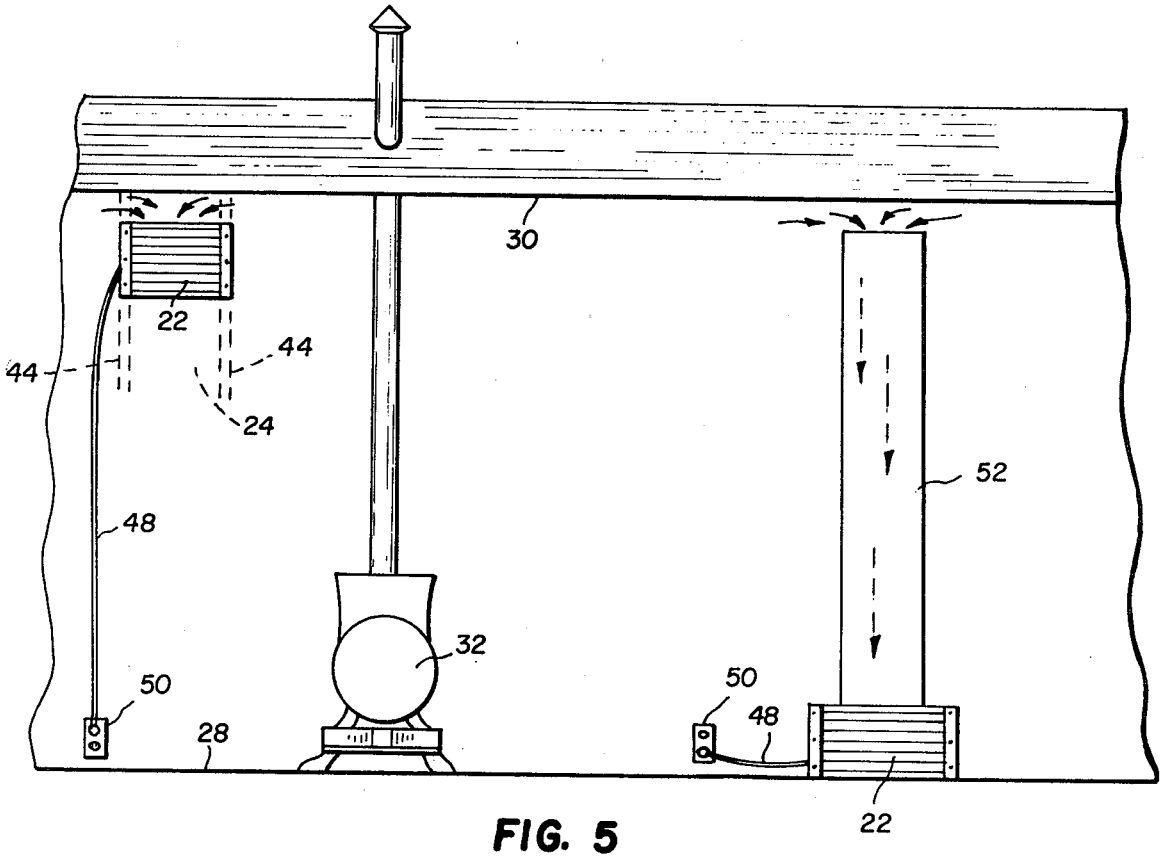
FIG. 5 is a side elevational view of a room showing possible locations of portions of the air distribution system of this invention.

With reference to FIG. 5, two possible installations of the heated air distribution system are disclosed for a room heated by an auxiliary space heater 32. It, of course, should be understood that these two systems are exemplary only, and that the heated air distribution system could be installed in many other forms, and the fan 36 located in other suitable positions in the air return system.

In one installation, the motor driven fan 36 is secured to spaced apart wall joists 44 within an upper duct opening, and then covered by the air return register 22. In this installation, the duct 24 comprises the conduit formed by a pair of wall joists 44 covered on each side by wall or plaster board 46 as seen in FIG. 2. The fan 36 is connected by an electrical cord 48 to an electrical outlet 50.

In another possible installation, the fan 36 is secured to the end of the air return duct 24 or between the wall or floor joists adjacent the floor 28. The duct end is covered by an air return register 22 for aesthetic purposes. For most efficient results, an upright duct extension 52 has one end secured to the lower opening in the air return duct or trunk 26, and its opposite open end positioned adjacent the ceiling 30 through which the higher heated air is drawn by the fan. In either installation, the fan 36 can be manually or thermostatically controlled.

It should be noted that in all of the discussed installations, the fan 36 may be easily installed with a minimum of labor by merely removing the existing air return register 22 from the air return duct 24, and mounting the fan into or over the opening in the duct, preferably by securing it to the wall joists 44. The register 22 is replaced and the electrical fan cord 48 plugged into an electrical outlet 50. Alternatively, register 22 may be left intact and fan 36 secured to the wall in alignment with the register.

In new building construction, the fan 36 may be mounted within the main air return trunk 26 located in the basement during installation of the forced air heating system. It should be noted that although the heated air distribution system utilizes the air return means of the forced air heating system, it operates independently of the forced air heating system and will in no way interfere with its operation.

The invention has been described in detail with particular reference to preferred embodiments, but it will be understood that variations and modifications can be affected within the spirit and scope of the invention as described hereinabove.

What is claimed is:

1. A heated air distribution system in combination with an air heating system for distributing higher heated air from a first room to lower heated air in a separate second room where an air temperature difference exists between said first and second rooms for any reason, said air heating system having an air supply means, a furnace for heating the air and supplying the heated air through said air supply means to at least one of said first and second rooms, and an air return means common to said first and second rooms for returning lower heated air from said first and second rooms to said furnace, said distribution system further comprising means coupled to said air return means for forcing higher heated air from said first room through said common air return means directly into said lower heated air of said second room for equalizing the temperature of the air in said first and second rooms.

2. The heated air distribution system of claim 1 wherein said heated air forcing means comprises a fan, and means for rotating said fan.

3. The heated air distribution system of claim 1 wherein said air return means comprises a duct, and said heated air forcing means comprises a fan mounted within said duct.

4. The heated air distribution system of claim 1 wherein said air return means comprises a duct having one end portion communicating with said first room and another portion of said duct communicating with said second room, and said heated air forcing means comprises a fan connected to said one end portion of said duct, and means for rotatably driving said fan.

5. The heated air distribution system of claim 1 wherein control means are provided in said first room coupled to said heated air forcing means for operating said heated air forcing means.

6. The heated air distribution system of claim 1 wherein said control means are thermostatic and operate said heated air forcing means when the higher heated air in said first room exceeds a predetermined temperature.

* * * * *